United States Patent [19]

Fischer

[11] 4,100,618

[45] Jul. 11, 1978

[54] APPARATUS FOR HIGH INTENSITY SHEAR REFINING OF SOAP

[75] Inventor: Charles F. Fischer, Jersey City, N.J.

[73] Assignee: Colgate-Palmolive Company, New York, N.Y.

[21] Appl. No.: 713,548

[22] Filed: Aug. 11, 1976

Related U.S. Application Data

[63] Continuation-in-part of Ser. No. 575,275, May 6, 1975, abandoned.

[51] Int. Cl.[2] ..... B01F 7/08

[52] U.S. Cl. ..... 366/297; 366/323

[58] Field of Search ..... 259/9, 10, 191, 192, 259/193, 97, 25, 26, 45, 46, 109, 110, 104; 425/207, 208, 209

[56] References Cited

U.S. PATENT DOCUMENTS

| | | | |
|---|---|---|---|
| 2,662,243 | 12/1953 | Schnuck | 259/191 |
| 3,305,894 | 2/1967 | Boden | 259/192 |
| 3,456,599 | 7/1969 | Baker | 259/191 |
| 3,711,067 | 1/1973 | Kovacs | 259/191 |
| 3,850,414 | 11/1974 | Scharer | 259/191 |

*Primary Examiner*—Robert W. Jenkins

*Attorney, Agent, or Firm*—Herbert S. Sylvester; Murray M. Grill; Kenneth A. Koch

[57] ABSTRACT

An apparatus for high intensity shear refining of soap. The soap mass is mixed at a rate of 3,000 to 40,000 shear cuts per minute. The apparatus includes a screw shaft rotating within a casing with the shaft having screw elements of varying pitch. The shaft and the casing comprise sectional assemblies each of which may include screws of different pitches and which can be arranged in variable lengths and combinations to make possible variations in mixing according to desired product variations. Each of the sections include a housing and a screw shaft of substantially the same length dimension so that the housings and the shafts are drivingly removably interconnected and the screw shaft and housing of each section are simultaneously connectable and removable as a unit.

6 Claims, 4 Drawing Figures

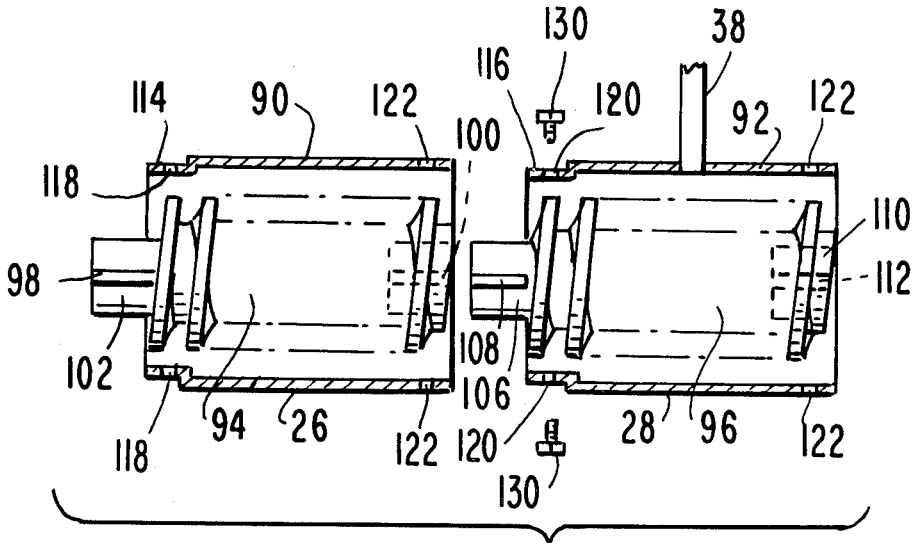

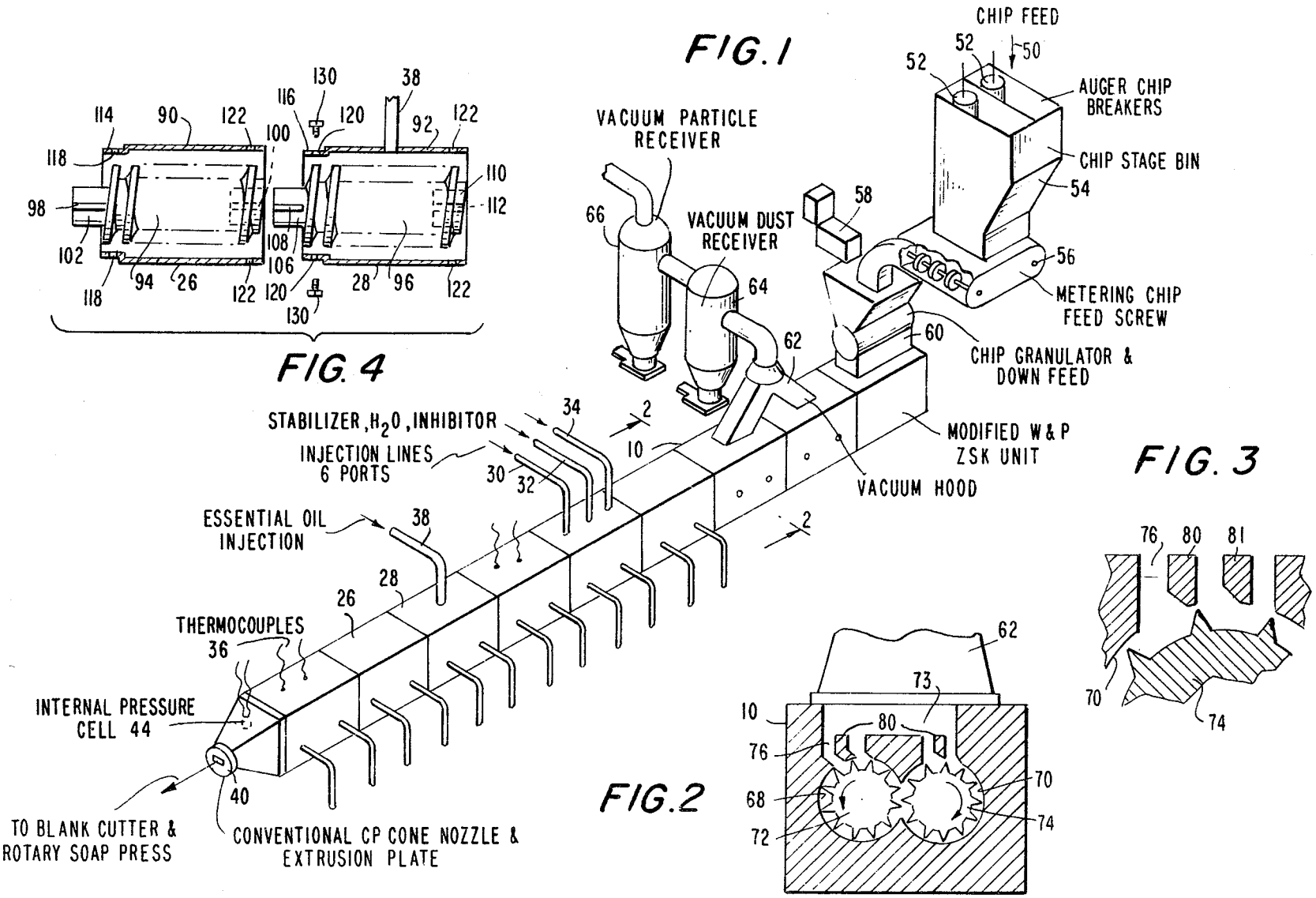
CHIP FEED
AUGER CHIP BREAKERS
CHIP STAGE BIN
METERING CHIP FEED SCREW
CHIP GRANULATOR & DOWN FEED
MODIFIED W & P ZSK UNIT
VACUUM HOOD
VACUUM DUST RECEIVER
VACUUM PARTICLE RECEIVER
STABILIZER, $H_2O$, INHIBITOR
INJECTION LINES 6 PORTS
ESSENTIAL OIL INJECTION
THERMOCOUPLES 36
INTERNAL PRESSURE CELL 44
CONVENTIONAL CP CONE NOZZLE & EXTRUSION PLATE
TO BLANK CUTTER & ROTARY SOAP PRESS
FIG. 1
FIG. 2
FIG. 3
FIG. 4

APPARATUS FOR HIGH INTENSITY SHEAR REFINING OF SOAP

REFERENCE TO RELATED APPLICATION

This application is a continuation in part of the application of Charles F. Fischer, Ser. No. 575,275, filed May 6, 1975 for APPARATUS FOR HIGH INTENSITY SHEAR REFINING OF SOAP PRODUCTS, now abandoned.

BACKGROUND OF THE INVENTION FIELD OF THE INVENTION

This invention relates to an apparatus for the processing of soap bars. More particularly, the invention relates to an apparatus for high intensity shear mixing and extrusion of soap bars.

DESCRIPTION OF THE PRIOR ART

Previous attempts to produce soap on a continuous basis have included the action of individual machines including: amalgamators, mills and soap plodders and devices for transferring the intermediate product between machines. The prior methods of production resulted in a relatively high capital cost and requirement for a relatively large amount of floors space. Improvements in the apparatus for producing soap on a continuous basis are shown in prior U.S. Pat. Nos. 3,446,485 and 3,481,880 and is described in Great Britain Pat. No. 1,308,410. This patent discloses the provision of a screw machine for extrusion of soap bars which has at least two parallel shafts disposed within a casing. The two shafts include screw flights which cooperate with each other and with the casing wall. The Great Britain Patent does not reveal the sectional concept of the present invention. One of the disadvantages of the apparatus according to the Great Britain patent is that the apparatus can not be easily readjusted for variations in mixing required by different soap products. Another disadvantage of the apparatus according to the Great Britain patent is that the apparatus requires cooperation of two interengaging screw shafts and the inside walls of a casing. This construction results in a requirement for complex machining operations during fabrication of the component parts with consequent relatively high capital costs. U.S. Pat. No. 2,595,455 issued May 6, 1952 to E. E. Heston for EXTRUDER does not disclose a plodding apparatus composed of detachable and replaceable sections including a housing and a screw shaft of the same length dimension. This feature is also not shown in the U.S. Pat. No. 2,662,243 issued to C. F. SCHNUCK et al on Dec. 15, 1953.

SUMMARY OF THE INVENTION

The present invention overcomes the problems of the prior art by providing for an apparatus for high intensity shear refining of soap. The soap mass is mixed at a rate of 3,000 to 40,000 shear cuts per minute. The present invention provides for at least one sectional screw shaft rotating within a sectional casing with the shaft having screw elements, having differing pitches. The shaft and the casing comprise sectional assemblies which can be detached and replaced according to need and which can be arranged in variable lengths and combinations to make possible variations in mixing according to desired product variations. The housing and screw shaft of each sectional assembly are substantially the same length.

It is an object of the present invention to provide for high quality finished soap bars by means of high intensity shear refining of soap using a sectional casing with sectional screw shafts and housings of substantially the same length.

It is a further object of the present invention to process and convert soap chips and essential ingredients to a firm quality soap extrusion by high intensity shear mixing at a rate of 3,000 to 40,000 shear cuts per minute using a screw type extruder having sections of varying forward and/or reverse pitch.

It is a further object of the present invention to provide an apparatus for the extrusion of soap having individual sectional extruder assemblies and individual sectional hob mixer assemblies making possible variations in the mixing of the end product in accordance with the number and order of assembly of the individual sectional assemblies.

It is a further object of the present invention to provide an apparatus for the extrusion of soap having a stub shaft mixer assembly.

These, together with various ancillary objects of the present invention are obtained by this process and apparatus for high intensity shear refining of soap, a preferred embodiment being shown in the accompanying drawings by way of example only, wherein:

BRIEF DESCRIPTION OF THE DRAWINGS

FIG. 1 is an overall schematic perspective view of an apparatus constructed in accordance with the concepts present invention;

FIG. 2 is a sectional view taken along the plane of the line 2—2 in FIG. 1, illustrating the construction of the hob mixer;

FIG. 3 is an enlarged fragmentary portion sectional view showing an atternate arrangement of the vacuum slots; and, FIG. 4 is a partial longitudinal sectional view illustrating two adjacent housing and screw shaft assemblies.

DETAILED DESCRIPTION OF THE INVENTION

With continuing reference to the accompanying drawing, wherein like reference numerals designate similar parts throughout the various views, reference numerals 10 is used to generally designate a casing in which a mass of intermediate soap product is subjected to high intensity mixing.

The casing 10 includes a plurality of sub-assemblies, shown typically as 26 and 28, which can be asembled in a plurality of configurations to accommodate a variety of end product mixing requirements. These sub assemblies incorporate screw shafts of different pitches as desired and hob mixers which are hereinafter described. Pipes 30, 32 and 34 provide means for introduction of stabilizer and inhibitor materials and water, respectively, into casing 10. Thermocouple 36 senses the casing 10 temperature. The pipe 38 provides means for injection of essential oils into casing 10. The cone nozzle 40 and extrusion plate 42 are mounted on the discharge end of casing 10. The extruded soap bar is discharged from casing 10 in the direction of arrow 43 and is fed to extrusion blank cutter and rotary press by conventional means. Extruded soap bars having high cone temperatures (127° F to 147° F) may be post conditioned in a cooling tunnel before or after the rotary press. Multicolored soap extrusions may be fabricated using this apparatus by injecting dye color liquid or colored soap into nozzle 40.

Soap chips are fed in the direction of arrow 50 to a pair of auger chip breakers 52 which are mounted on chip stage bin 54. Metering chip feed screws 56 are controlled by chip rate weigh master 58 and feed soap chips to the chip granulator and down feed 60 which leads to the casing 10. Vacuum hood 62 projects upward from the casing 10 and leads to the vacuum dust receiver 64 and vacuum particle receiver 66.

Barrel bores 68 and 70, shown in FIG. 2, are formed in the casing 10 directly below the vacuum hood 62. Stub screw shafts in the form of hob wheels 72 and 74 are rotatably mounted and connected to driving means such as adjacent interconnecting stub shafts of an adjacent casing section for rotation. In the directions shown by the arrows in FIG. 2. Vacuum slots 76 lead from barrel bores 68 and 70 to vacuum chamber 78. Vacuum slots 76 have slot back relief portions or baffle as shown in FIG. 5. As shown in FIG. 3, two slot back relief potions baffles 80 and 81 may be provided if desired.

The casing 10 includes a barrel bore which houses a rotatably mounted screw shaft which has screw flights of varying pitch and pitch direction. The screw is formed in sections which correspond in length to the sections of casing 10 thus making possible the combination of various sections of screw shaft and casing to achieve various mixing results. The screw shaft is connected to driving means and is driven at a single relatively low rotational speed and the apparatus accomplishes the performance of high intensity shear cuts ranging from 3,000 to 40,000 shear cuts per minute through the action of the various combination of lead screw sections lead screw pitches and hob mixers.

Referring now to FIG. 4, it will be seen that the casing sections 26 and 28 include housings 90 and 92 and screw shafts 94 and 96. The housings 90 and 92 and the screw shafts 94 and 96 of substantially the same length dimension. The shaft 94 is provided with splines 98 on a reduced diameter end 102 and have keyways 100 at the other end within sockets 104 for receiving end 106 and spline 108 of shaft 96. A socket 110 and keyway 112 is provided in the other end of shaft 96.

The housings 90 and 92 have portions 114 and 116 of reduced dimensions for partially telescoping within the adjacent housings and have apertures 118 and 120 adapted to allign with the holes 122 of adjacent sections so that screws 130 or like fasteness can be used to secure the housings to each other in a replaceable detachable manner.

In an alternative construction, the casing 10 has two screw shafts mounted parallel to each other in separate barrel bores for the purpose of increasing the overall mixing capacity of the apparatus.

A latitude of modification, substitution and change is intended in the foregoing disclosure, and in some instances, some features of the present invention may be employed without a corresponding use of other features.

What is claimed is:

1. An apparatus for the continuous production of soap comprising a plurality of detachable and replaceable sections, each of said sections including a housing and a screw shaft that are coextensive said housing and screw shaft having substantially the same length dimension, each of said screw shafts having flights thereon, each of said sections including means for removably interconnecting said housings and drivingly and removably interconnecting shafts, and rotating means for rotating said screw shafts at a predetermined rate, said means for drivingly and removably interconnecting said shafts including reduced end portions provided with splines and having complementary sockets and keyways for receiving said end portions and splines, whereby said screw shaft and housing of each section are simultaneously connectable or removable as a unit.

2. An apparatus according to claim 1 wherein said pretermined rate is from 3,000 to 40,000 shear cuts per minute.

3. An apparatus according to claim 2 wherein the flights each of said screw shafts have a different pitch.

4. An apparatus according to claim 1 wherein said housings are partially telescoped, and comprises fastening means detachable securing said housings through said telescoped portions.

5. An apparatus for the continuous production of soap comprising a plurality of detachable and replaceable sections, each of said sections including a housing and a pair of screw shafts disposed in side by side parallel relationship, said housing and pair of screw shafts having substantially the same length dimension and being coextensive, each of said screw shafts having flights thereon, each of said sections including means for removably interconnecting said housings and drivingly and removably interconnecting said shafts, and rotating means for rotating said screw shafts at a predetermined rate, whereby said screw shafts and housing of each section are simultaneously connectable or removable as a unit.

6. The apparatus of claim 5 wherein each pair of screw shafts have flights thereon having a different pitch from the flights on adjacent pairs of screw shafts.

* * * * *